United States Patent [19]

Elling et al.

[11] 4,413,583

[45] Nov. 8, 1983

[54] PLASTIC LIFEBOATS

[75] Inventors: William E. Elling, Metuchen, N.J.; by Hanny M. Elling, executrix, St. Louis, Mo.

[73] Assignee: Hanny M. Elling, St. Louis, Mo.

[21] Appl. No.: 104,798

[22] Filed: Dec. 18, 1979

[51] Int. Cl.[3] ..... B63B 43/02; B63C 9/02

[52] U.S. Cl. ..... 114/350; 114/360; 114/123; 114/144 R; 440/24

[58] Field of Search ..... 9/3, 4 R, 4 A, 43, 44, 9/45, 2 A, 14; 114/348, 349, 355, 357, 360, 361, 123, 144 R; 440/24

[56] References Cited

U.S. PATENT DOCUMENTS

| | | | |
|---|---|---|---|
| 3,121,888 | 2/1964 | Morgan | 9/3 |
| 3,295,151 | 1/1967 | Hall | 9/4 R |
| 3,806,971 | 4/1974 | Elling | 9/3 |

FOREIGN PATENT DOCUMENTS

| | | | |
|---|---|---|---|
| 2451830 | 5/1976 | Fed. Rep. of Germany | 9/4 R |
| 655349 | 7/1963 | Italy | 9/4 R |

*Primary Examiner*—Robert B. Reeves
*Assistant Examiner*—Donald Hajec

[57] ABSTRACT

Sea-going lifeboats made of thin-walled, fiberglass-reinforced plastic (F-R P), with an oversupply of poured-in-place urethane foam in functionally advantageous spaces; having totally watertight or weathertight covers; with bow-pull hand-propeller replacing rowing oars. A hand driven, multi-purpose flywheel for Diesel engine starting, dynamo for lights and radio, et-cetera; with hanging steel pipe structure in the bilge supporting heavy items, which are compacted close to the keel. Outer hull doubling allows space for stowage of an automatic inflatable rubber air tube on each side of the lifeboat.

10 Claims, 46 Drawing Figures

FIG. 6
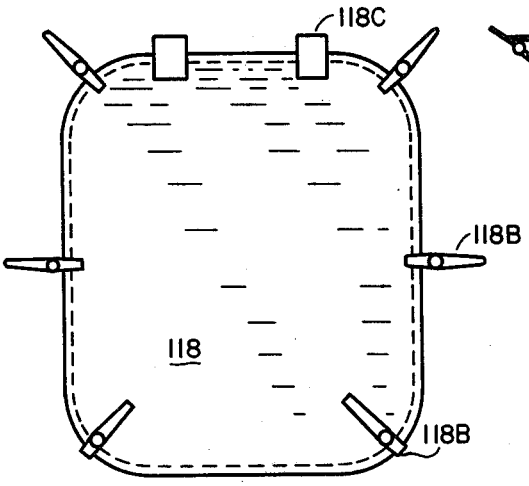
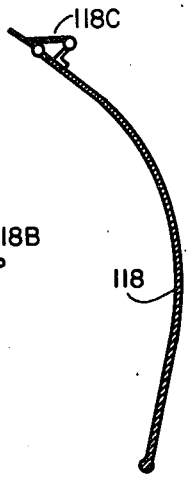
FIG. 7
FIG. 9
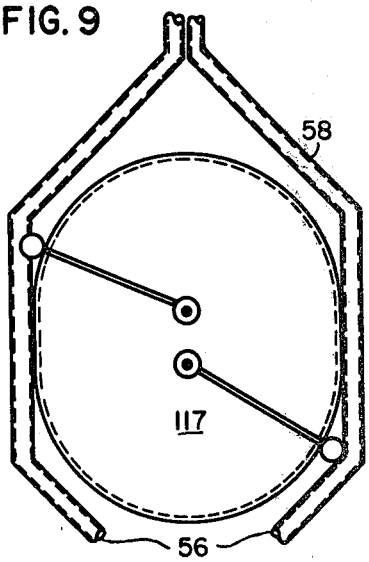
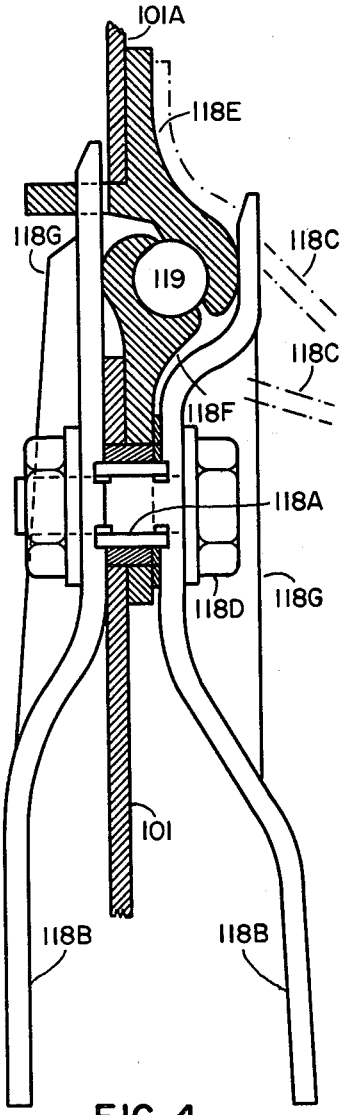
FIG. 4
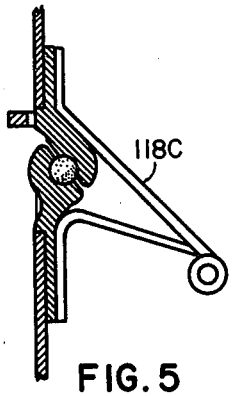
FIG. 5
FIG. 8
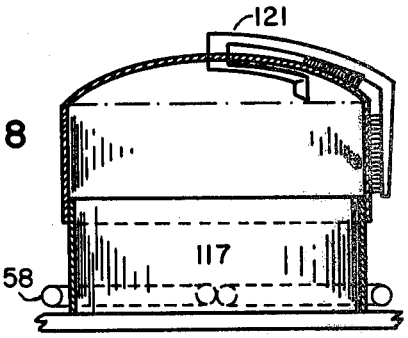
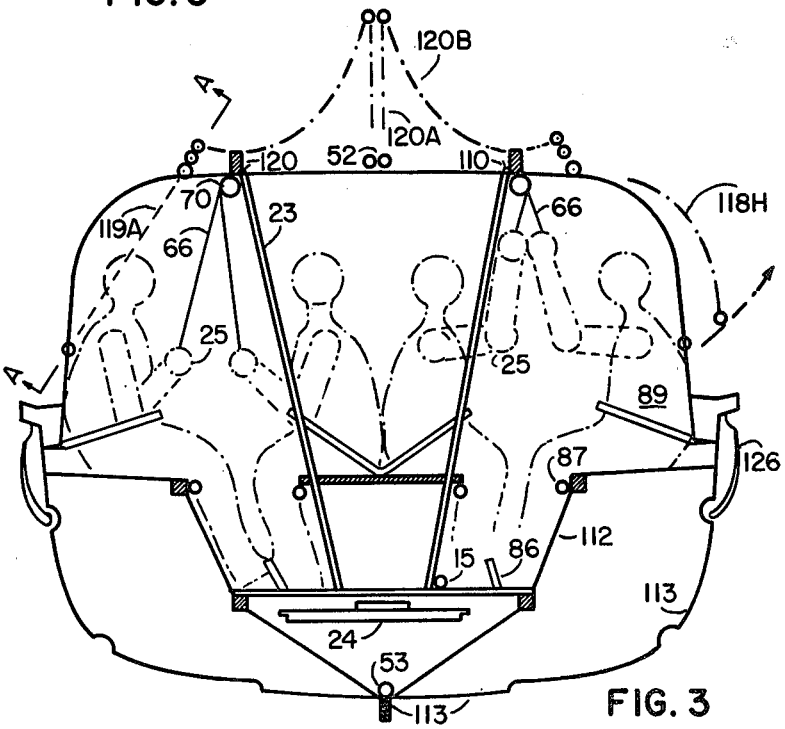
FIG. 3

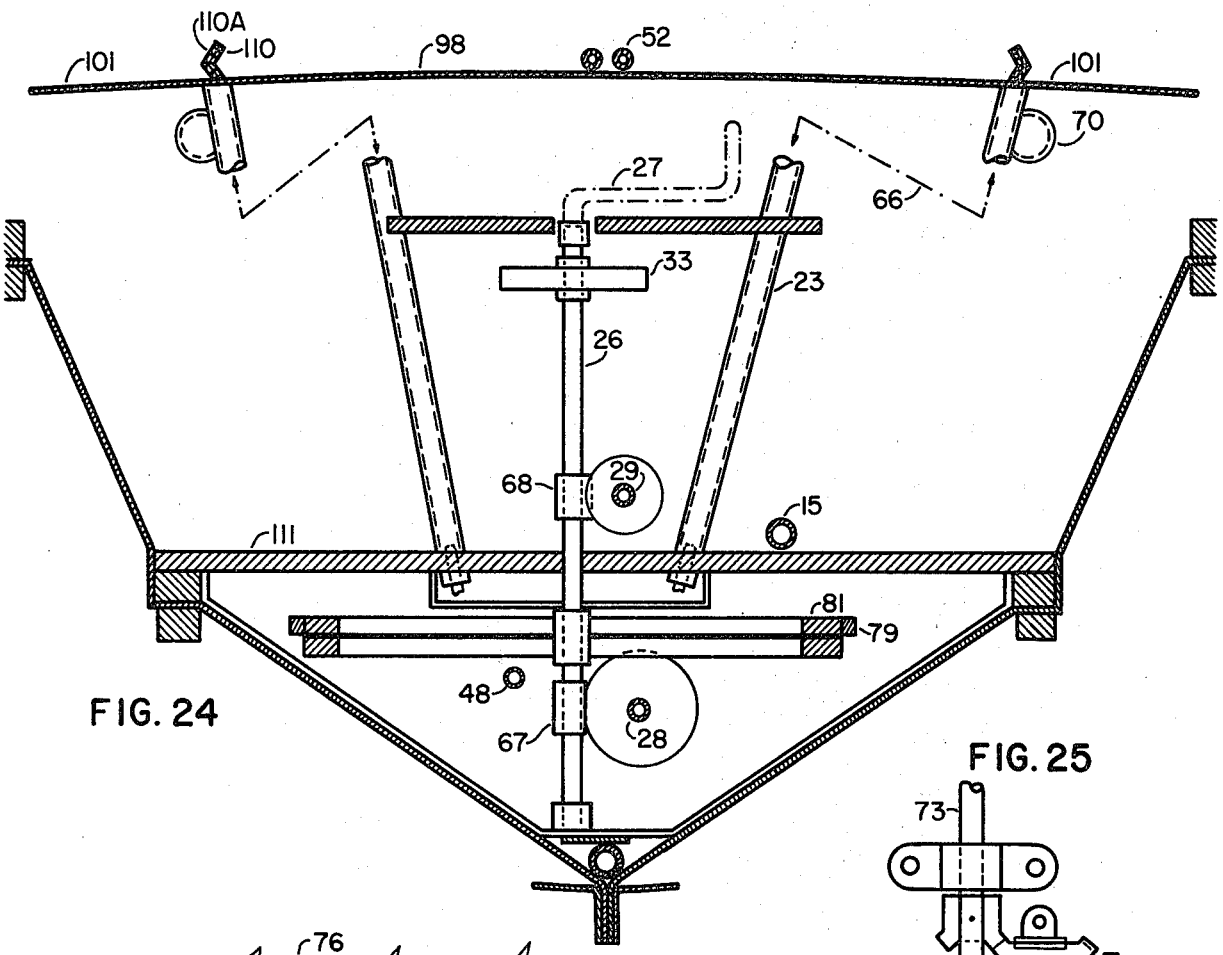
FIG. 24
FIG. 25
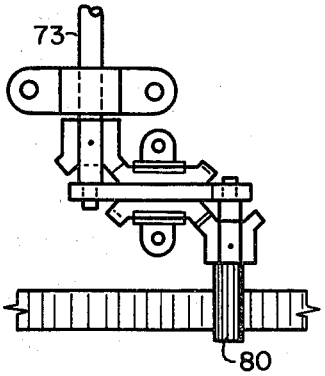
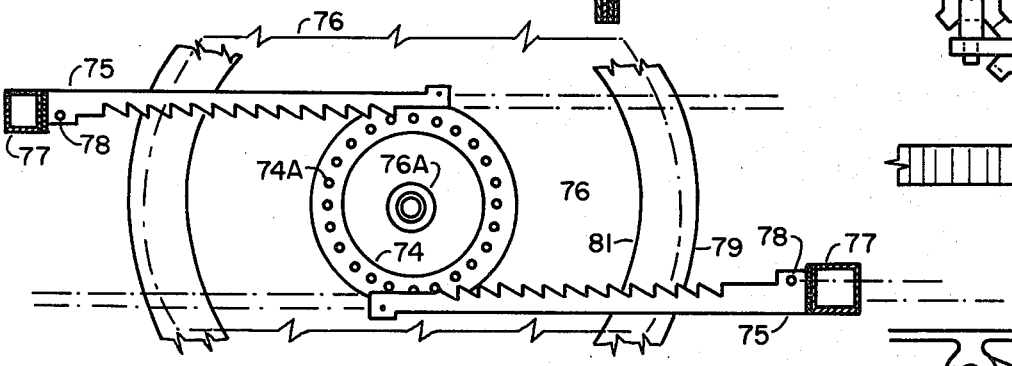
FIG. 23
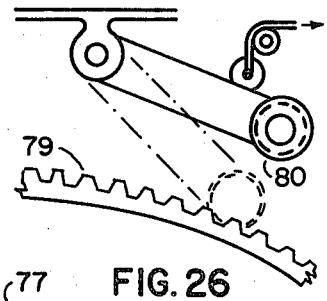
FIG. 26
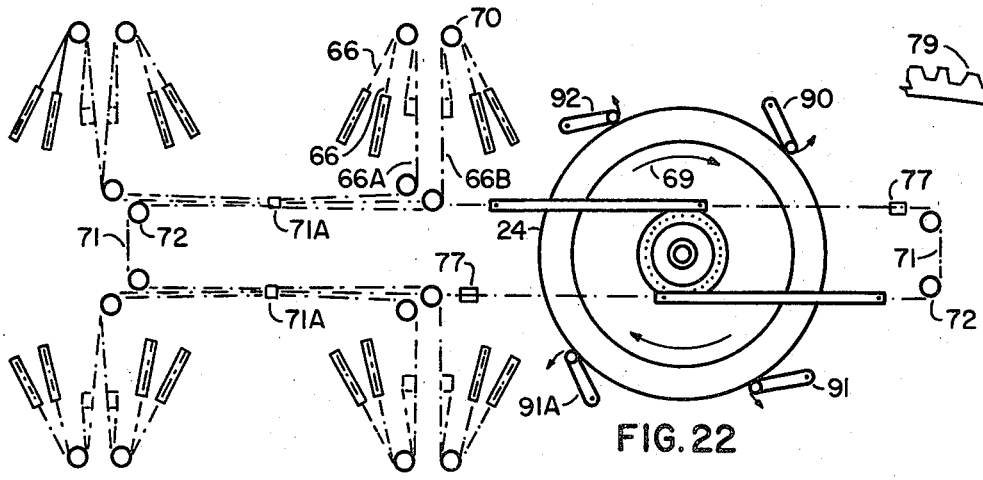
FIG. 22

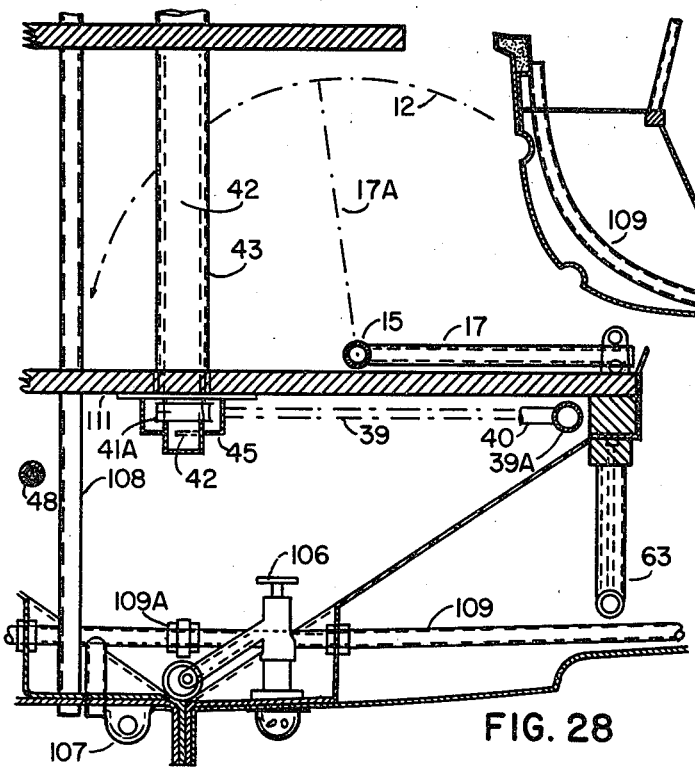
FIG. 28
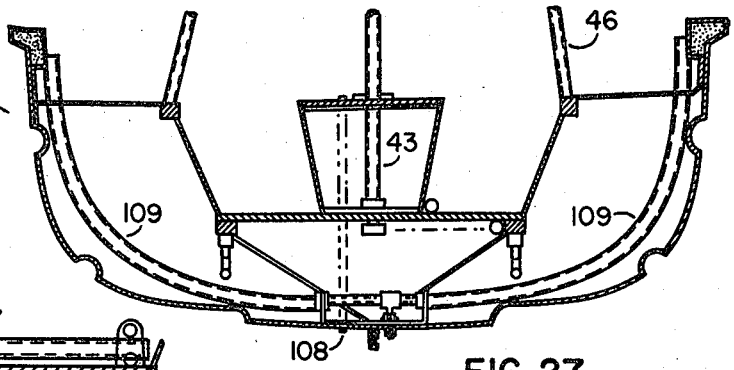
FIG. 27
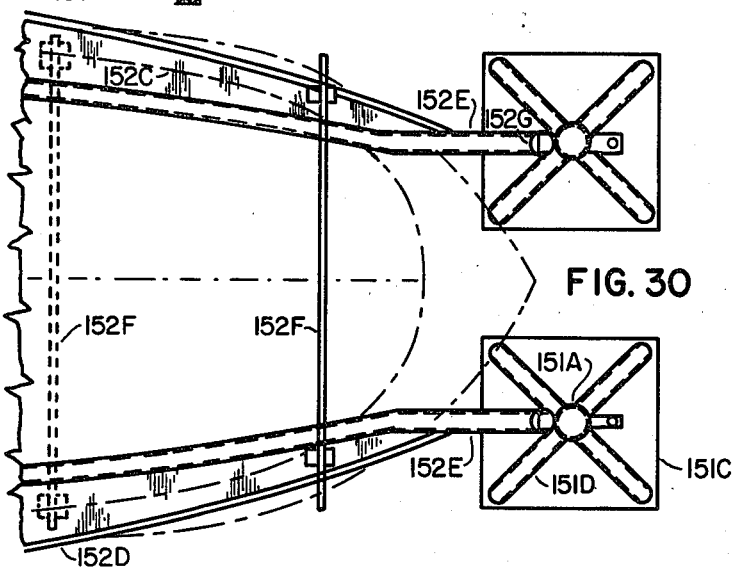
FIG. 30
FIG. 29
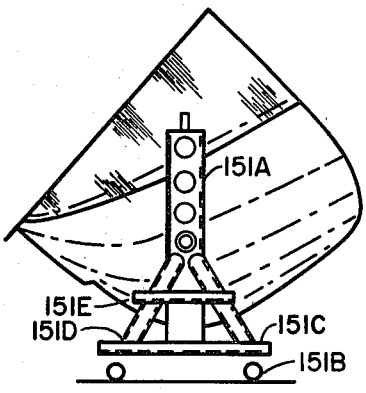
FIG. 31
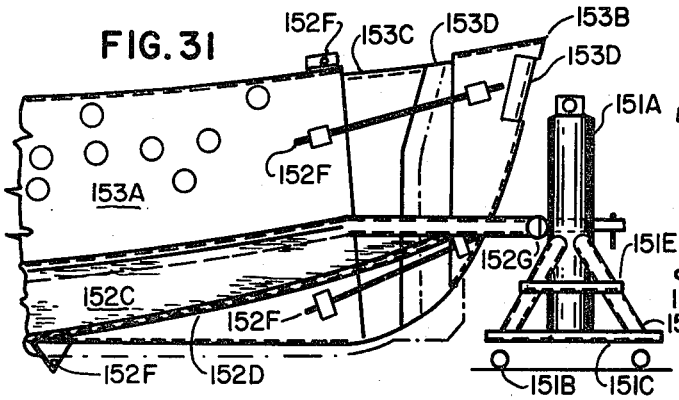
FIG. 32
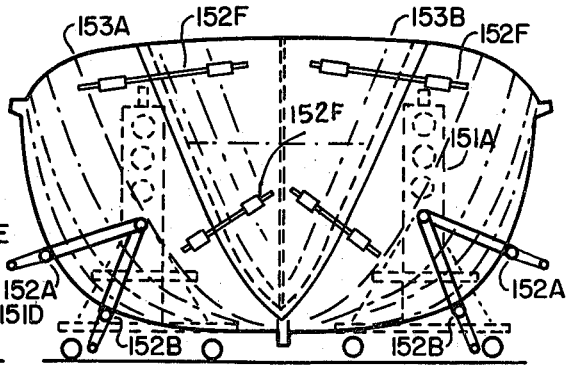

FIG. 33
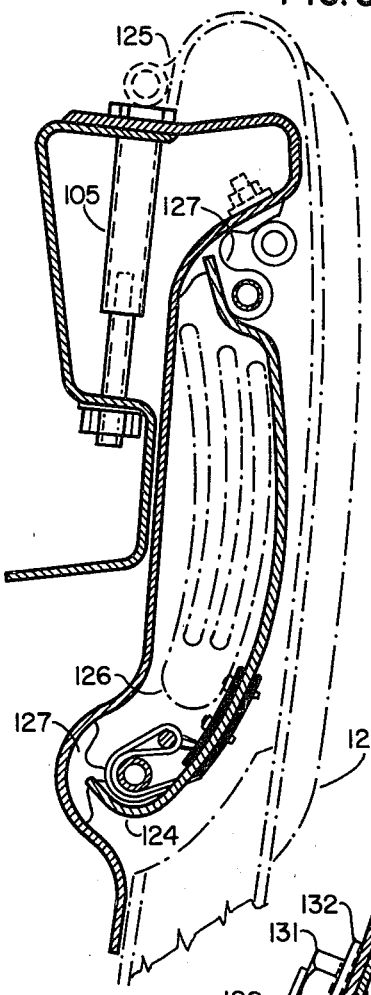
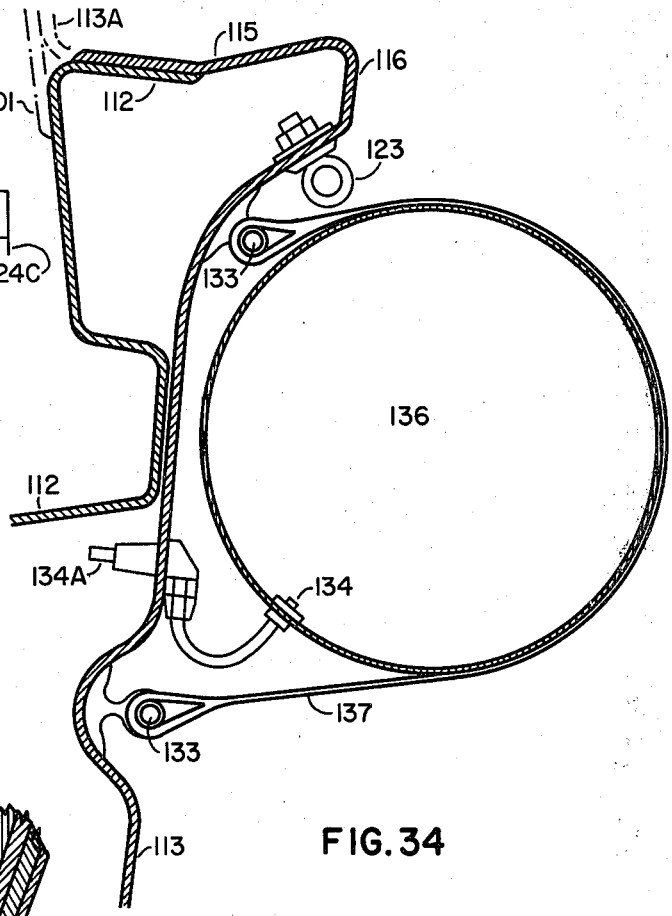
FIG. 34
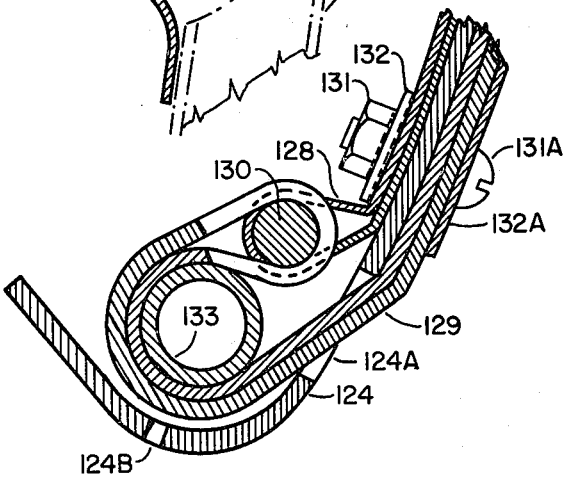
FIG. 35
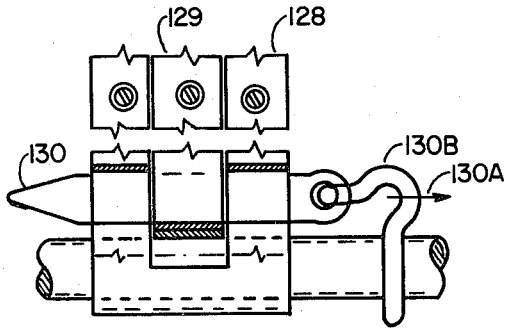
FIG. 36
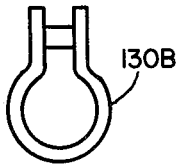
FIG. 37

PLASTIC LIFEBOATS

This invention relates to new and useful improvements in lifeboats for use on ships or oil drilling rigs, for the safety and comfort of occupants, during adversity at sea, complying in all respects with the regulations of the principal maritime countries and, in particular, with those of the United States.

The following are considerations valuable to the understanding of this invention:

A. In recent years, especially since the issue of Elling U.S. Pat. No. 3,806,971, Plastic Lifeboats, and with the advent of oil or gas drilling rigs in ocean waters, totally covered lifeboats have been introduced as a protection against explosions, fire and toxic gasses. It is a major objective of this invention to provide means for adding watertight rigid covers, which are strong enough to support a fully loaded lifeboat when capsized in open water; furthermore, to provide positive means for the avoidance of capsizing. In heavy weather the capsizing of a lifeboat is anticipated most often when it is broad side to the waves, and to keep it heading into the wind, something other than a sea anchor should be used in moments of great anxiety. Also, rowing oars are not of much help in the high seas of bad weather. This invention has provided a safe method of keeping the bow of a lifeboat heading into the wind, and thereby helping to prevent capsizing, by means of a bow-pull propeller, which operates equally well in good or bad weather. The rigid and totally watertight cover is made up of five sections and each joint between has bent-up flanges which are flush against one another in a zigzag fashion for bonding, stiffening and to serve as a hand rail by a person on the gunwale walk way. In addition, the longitudinal side joints are directly below the line of cover support stanchion tubes, which also serve for passage of pull cables. The cover support stanchions are leaning opposite ways, so as to keep the cover steady.

B. In a totally covered lifeboat, the steering position has been changed from the stern position in a previous standard lifeboat, to a raised position at about amidship, where the helmsman's head is jutting out above the cover top into a transparent dome, or bubble. The longitudinal dimension is greater than the width of the bubble, and two separate wipers have been provided. On the top of the center cover section there are two water sprinkler pipes, side by side, for watering each side separately. Items in the stern of either lifeboat type have been arranged so that steering, hoist hook release, hook well and service hatch in the cover hood do not interfere with each other. The rigid cover sevice hatch on the starboard side aft, is suitably situated for a person standing in the opening on the seat below for emergency steering and other emergency duties. An identical hatch is located on the port side forward, which makes both identical to one another. These service hatches are watertight or weathertight. The combination of a quadrant rudder tiller and a rotating pinion shaft has made the steering, clear of the hoist hook, possible. The division of the lifeboat cover into five sections has made it feasible to reduce the number of lay-up operators to only one per section, if this is advisable for saving time and added quality. It also has provided necessary cover stiffening and the required hand grab rails.

C. The Elling prior U.S. Pat. No. 3,806,971, was for an open lifeboat with an automatic drain and a sea water intake in the bottom. Such openings might not be allowed in lifeboats with totally watertight covers because of a requirement for certain steady inside air pressure. Capsized lifeboats with weathertight covers are sometimes difficult to be returned to upright because of some air pressure difference, caught under the gunwale. This is rectified by built-in air tubes, leading through the side tank foam and equalizing the air pressure, so that the occupants will have no difficulty in re-righting the boat. In manufacturing lifeboats of this invention, a decision in regard to the type of cover does not need to be made until later. Three of the cover sections are identical for either boat type, except the hatch for the coverend hood is either watertight or weathertight, and so are the two side cover sections. The two end parts and the middle part of the latter are secured by inside straps to the curved tube supports, which are anchored in gunwale sockets, and the two entrances and exit parts also have straps for securing. All five canvas parts on each side of the lifeboat are rolled up and secured against the zigzag flange of the rigid cover section. These are releasable and watersoaked within seconds and on one side of the boat only if the other side is being boarded.

D. Not long ago the administrations of seafaring nations accepted the requirement for simultaneous release of both hoist hooks in ship's lifeboats, which will probably lead to dropping lifeboats from a greater height than the present test heights, and it is an object of this invention to provide means for having all heavy items in the lower part of a lifeboat resting one on the other. Therefore, instead of a plastic keel, which is preventing the low placement of heavy weights, and the horizontal placement of machinery shafts; a horizontal backbone pipe with numerous steel clips welded to same, being laid down at the lowest point above the keel and said clips with bolted connection to the laminated wood stringer at the knuckle of the inner hull on each side, which has bolted connection to the strength floor. Such compacted design has lowered the center of gravity considerably so that capsizing will not occur as long as occupants remain in their seats. The stringers and girders with the structure of the plastic inner and outer hulls enclose a great amount of urethane foam, which has a weight of two pounds per cubic foot and provides comparatively high compressive strength. The involved major items are: diesel engine, full forty gallon fuel tank, emergency water tank, provision water tanks, and energy fly wheel; all resting snugly on said backbone steel pipe, which is braced to the floor stringers. It is the common desire of all concerned persons to have a capsized lifeboat return to the up-right position, inherently or automatically. This has been achieved to a great extent by this invention.

E. An object of this invention is to provide a strong universal ball joint for the simultaneous release, under load, of the two hoist hooks, and having the hook tails in line with the tubular rods between the hooks; and two or more joints, each comprising a ball, whose diameter is the same as the inside diameter of the tubular rod and three pins, one through-pin and two short pins at each joint. The tubular rod ends are ear-shaped and with holes to suit said pins. To keep the short pins and one end of the long pin in place without sliding out, the pins may be machined with a shoulder and the ear-shaped tube ends may be machined to suit, and one end of the through-pin may be secured by set screws or may be secured with a sheet metal cover, or each pin could be secured with a cover. The tubular rod toward the hooks on each end has a cup-shaped terminal attached to it's end, which is partly open on one side. The cup is engaging the end of the hook tail and when the tubular rod is turned by a lever, which is attached to it near the pilot's chair, both hooks are simultaneously released.

F. It is an objective of this invention to provide means for achieving positive assurance that the outer hull and the inner hull skins, which are made to a relative thin thickness, and which have no framing whatsoever, will remain true and straight against twisting during the whole period of assembly, and especially during and beyond the pouring and curing of foam. A twist is a bad mark against quality and can never be rectified. On the other hand, if a body is foamed when straight, it will remain straight. Lifeboat parts, even if made to exact dimensional procedures, will show discrepancies which are different from one fabrication to the next and the reason cannot be pinpointed unless parts are clamped in exactly the same position. Man hours saved may come to fifty percent. The clamping devices of this invention are the tangible means of proceeding step by step, in strict accordance with a schedule, so that any discrepancy in the size or fit of items will be noticed without fail. This needs to be done only once or twice when any modification should be necessary. Such simple procedure with a definite clamping of parts during pouring and curing of foam and curing of adhesive bonding will induce confidence with the government inspectors, who otherwise would be continuously in attendance. The rotating rig used for lay-up of fiberglass, as mentioned in the previous Elling patent, had stationary pedestals at each end and did not disclose means for the prevention of twisting before and after the pouring of liquid foam, which can only be done in a positively controlled assembly machine, which allows not only rotation, but also an oblique fore and aft position for the better distribution of liquid foam. A universal ball joint is installed in the horizontal pipe near the pedestal post.

G. This invention has made the gunwale top and gunwale nosing combination safe for walking along the cover by inclining the nosing top up, from it's intersection with the gunwale top. The gutter, which is hereby formed, offers a much safer foot hold. At the lowest point of the boat sheer, a narrow overboard drain is formed for waters from the bow and stern. For seat security, an object of this invention is to provide each person with two head holds and two foot holds, in addition to a lap seat belt with a buckle pushbutton release. Special hand and foot holds attached to the inner hull and floor structure are conveniently suited for the lifeboat occupant to stretch out during anxious moments and still hold on.

H. With the installation of watertight or weathertight lifeboat covers, it is important to plan for the safety of occupants seated close to the swing of the hoist hook when being released; therefore, the hook well has been made part of the rigid cover-end-hoods at bow and stern. It is isolated from the seating area. The swing action of the hook can be observed through a transparent, hinged, watertight hand hole. In front of the pilot's seat is a vertical steering post, having a horizontal steering stick at it's top and a cable drum at it's lower end, below the floor. A cable leads over fairlead sheaves to a similar cable drum, which is connected to the end of a pinion shaft and which is engaged to drive the teeth of the quadrant tiller on the rudder stock.

I. Very effective means have been provided by this invention for the installation of deflated rubber tubes on each lifeboat side under the gunwale nosings. They are protected in their stowage position by close fitting, rigid plastic covers, which can be jettisoned automatically, and the tubes can be inflated by remote action from the inside of the lifeboat. Rapid inflation of the stowed air tubes may be actuated by remote instant opening of a pressure vessel; or, if time permits, the air tubes may be filled by an air pump, driven by the energy flywheel. In either case, the lifeboat must first be waterborne, so that the skid fenders can be abandoned.

J. It is an object of this invention to provide means for the installation of a multipurpose flywheel under the floor of a lifeboat so as to use the energy of occupants for serving either of the following: water sprinkler pump, air pump, bow-pull propeller, dynamo for radio, diesel engine starter, gyroscope and others. Sixteen pull cables and hand sticks have been set aside for the occupants to pull from overhead pulleys in stanchion tubes through a short "pull cycle", followed by a "let go cycle", so that the saber blade teeth engage the pins of the pinion pin rings, which are attached to the top side of the flywheel base plate. The points of attachment of the endless cable to the saber blades is such as to pull the teeth towards the pins during the "pull cycle" and off the pins during the "let go cycle". The second endless cable ring with identical tooth arrangement is being installed but it is not shown on the drawing for clarity reasons. Between cycles, the pulling occupant will notice a bump against a rubber or spring loaded stopper, indicating a change of cycle, which will help him to keep his intoned chant coordinated. Another sign of pulling coordination is when one half of the pulling stocks are at the top and the other half are down.

The power take-offs from the energy flywheel are either through worm gearing from the flywheel shaft; or, from a pinion matching an endless gear rack on the outside of one of the flywheel rings. The meshing and unmeshing of the starter pinion in the diesel engine flywheel gear rack is through the mechanism as furnished with the Diesel engine, which has been used in automobiles for over fifty years. The means for hand power is provided by this invention.

Plastic lifeboats embodying this invention are shown in the accompanying drawings, of which:

FIG. 1 is an outside elevation of a diesel powered lifeboat with a rigid, watertight cover.

FIG. 2 is a plan view of the lifeboat in FIG. 1. Occupants have been indicated in spaces occupied, and sixteen are manning pull-cables for rotating an energy flywheel. In this plan view there are indicated four sideways slanted, tube cover stanchions sforward of midship, in which the said pull-cables are passing to the flywheel. At midship center, the pilot is on a raised chair where many of the controls are within his reach, and the cables of same are brought up or down through the tube cover stanchions on each side of his chair. Many of the control cables, or air tubes, are installed in the buoyancy tanks before the foam is poured. Some of the engine controls will be brought down through a vertical cover stanchion, just aft of the engine at center line.

FIG. 3 is a section of the plastic lifeboat in FIG. 1. Occupants have a regular seat belt with a buckle pushbutton release. Furthermore, because of a possible boat roll-over during a capsize, each person has a sandal strap for each foot, attached to the floor, and two hand hold straps, attached to the seat stringer. In regard to the watertight hatch gasket, the line A—A, crossing the gasket at top and bottom will show that the clamp pressure is at nearly right angle at top and bottom.

FIG. 4 is a hatch clamp for the watertight rigid cover. It can be opened or closed from inside or from outside.

FIG. 5 is one of the two hatch hinges in smaller scale.

FIG. 6 is an outside view of one of four hatches, each with six clamps and two hinges.

FIG. 7 is a section of the hatch, showing the curvature of the rigid cover.

FIG. 8 is a sectional elevation of FIG. 9. The pilot's bubble is needed in a lifeboat with a soft cover as much as in a lifeboat with a rigid cover.

FIG. 9 is a top view of the pilot's bubble, with the sprinkler pipes leading around it.

Figures 10, 11, 12, 13, 14, 15:
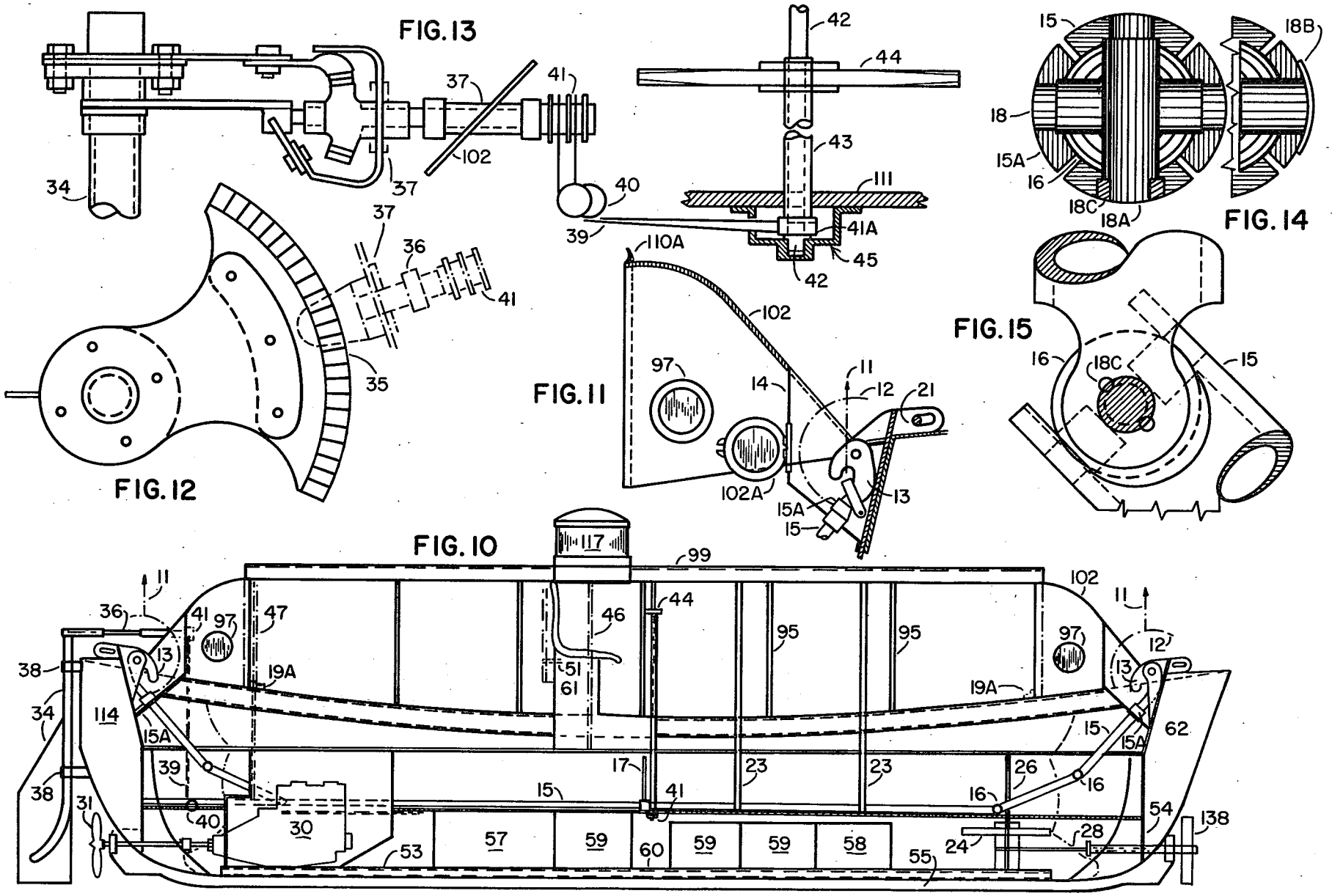

FIG. 10 is an inside elevation of a diesel powered, plastic lifeboat with a partly rigid and partly weathertight cover and it has slanted support stanchions, which are also conduits, identical to stanchions in a lifeboat with a watertight cover. Other items, which are identical for either boat type, are: rigid cover hoods, hook wells, observation dome, steering, hoisting, engine, bilge tanks, flywheel, bow-propeller and backbone keel pipe. The added weight in the bilge is good for stability.

FIG. 11 is a rigid cover-end hood, combined with hook well. It has a zigzag flange which connects with the zigzag flange of the top center cover section and with the canvas cover side pieces. It has two round, fixed windows and one hinged window. It has a weathertight hatch on the port side and same hatch opposite aft.

FIG. 12 is a quadrant tiller with a quadrant pinion shaft and cable drum pointing to the port side of the boat to avoid interference with hoist hook.

FIG. 13 is an elevation of the quadrant and pinion shaft in FIG. 12, and shows steering column with cable drum and steering stick on a loose sleeve, which turns on a stanchion.

FIG. 14 is a sectional view of a universal ball joint between two tubular rod ends, where a ball or sphere is snugly, without tolerance, inside of said tubular rod ends. Each of the ends has two ears; and, of the four ears, one ear has a pin size hole and three ears have slightly smaller pin holes. Therefore, two short pins and one longer pin have a shoulder on one end. During assembly, insert the short pin in the ball and put ball in place. Push the two short pins with the shouldered ends into the smaller pin holes from the inside. Then, insert the longer pin through the one large pin hole. As an alternate, to keep the pins from sliding from their positions, the pin holes may be bored to full diameter size and may be covered with thin, stainless disks, poke-welded in place.

FIG. 15 is a side view of the assembled universal ball joint.

Figure 2:
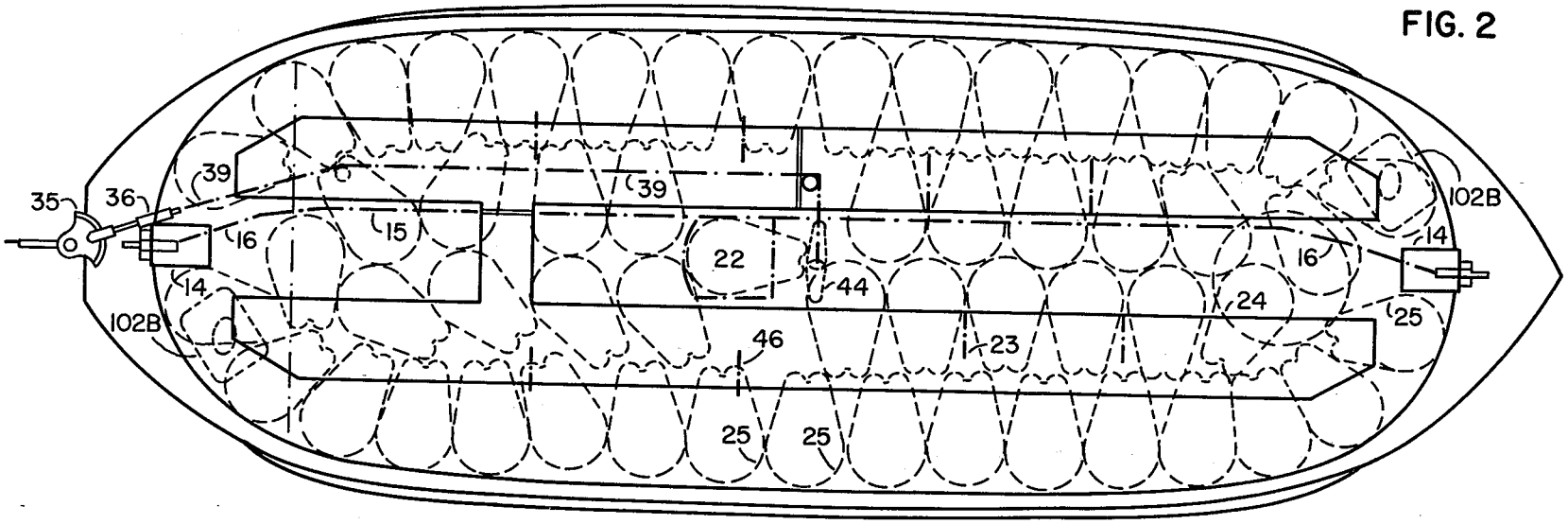
Figure 1:
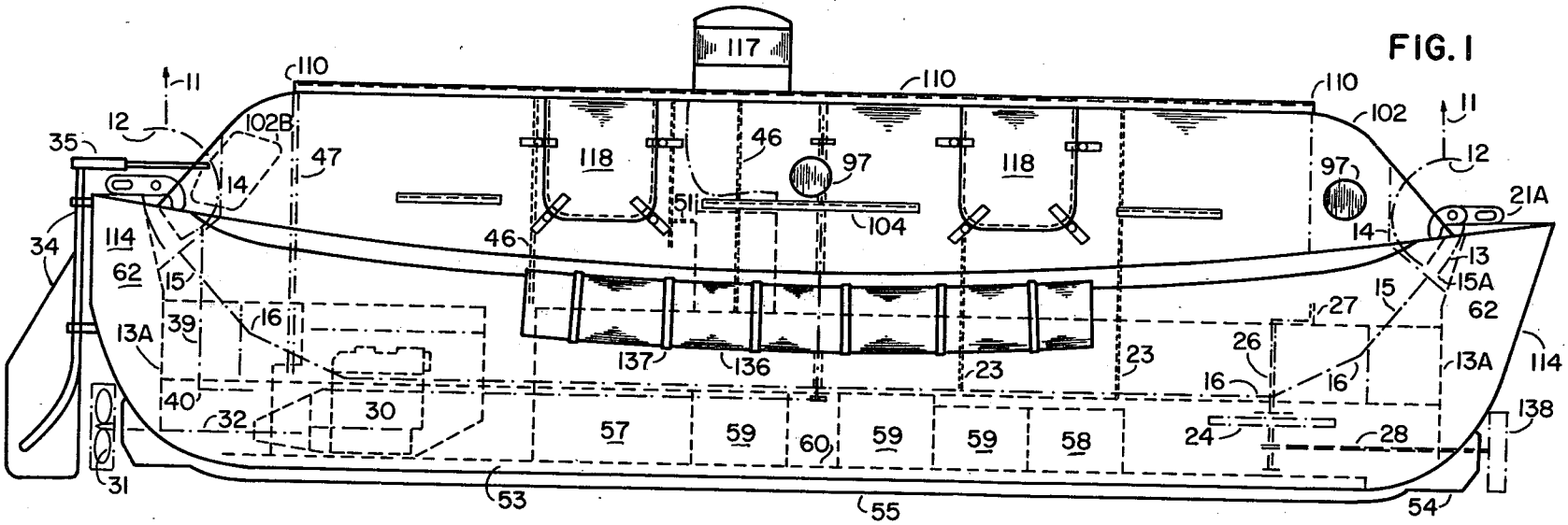
Figures 16, 17, 18, 19, 20, 21:
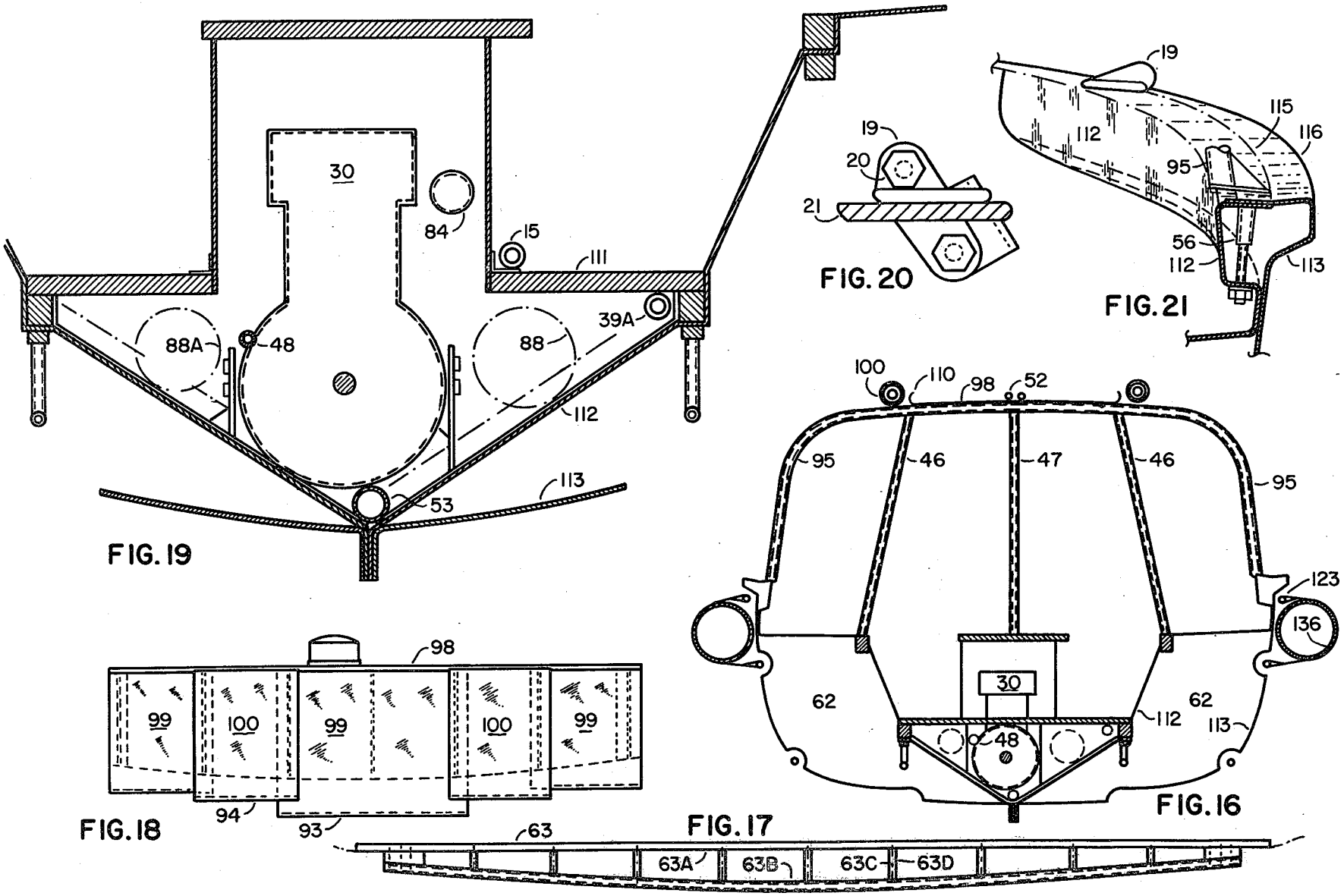

FIG. 16 is a sectional view of the lifeboat with the weather-tight cover in FIG. 10, identical to plastic lifeboats in FIGS. 1 and 2, except that this lifeboat has a weathertight cover of partly canvas; and, therefore it is called an open lifeboat.

FIG. 17 is a stringer assembly, forming a girder under the inner hull stringer for additional support.

FIG. 18 is a side view of rolled-down canvas cover parts of plastic lifeboat, FIG. 16. The canvas center piece is secured by inside straps to the tube stanchions, and so are the two end pieces. The two other pieces adjacent to the center piece are exit and entrance pieces and they can be opened or closed from outside or inside.

FIG. 19 is a larger scale section of the bilge area of FIG. 16. All heavy items in the bilge space under the floor are compacted and held by steel bars and non-corrosive metal straps, which are secured to the backbone pipe and bolted to the inner hull stringer.

FIG. 20 is a fractional top view of the gunwale-top boat gripe cable fitting at both sides of each boat end, near the davits, substantially secured for holding the lifeboat firmly inside the davits.

FIG. 21 is a section of the gunwale with a background of the inner hull end. It also shows a side view of the gripe fitting in FIG. 20, and the end of a cover support frame in FIG. 16.

FIG. 22 is a schematic arrangement of hand pull cables, moving an endless cable ring with two tooth saber blades, which are intraconnected within said cable ring so that the centers of the blades coincide with the center of the flywheel and the flywheel pinion. There is an identical arrangement on a second level. For clarity in the drawing, the second cable ring has not been shown. Both cable rings are moving back and forth; but, when the upper is in the "pull-cycle", the lower cable ring will be in the "let-go-cycle".

FIG. 23 is a larger scale plan view of saber blades and flywheel, with the saber teeth engaging the through-pins in the pinion rings when reciprocating in cycles. The points of attachment of the endless ring to the said saber blades is such as to pull the teeth towards the through-pins during the "pull-cycle" and off the through-pins during the "let-go-cycle".

FIG. 24 is a section of the inner hull, strength floor, keel, flywheel with shaft and center base foundation. It is also indicating slanted cover support stanchions serving as conduits for hand pull cables.

FIG. 25 is a schematic elevation of a power take-off from a toothed, endless rack on the periphery of the flywheel ring through a pinion.

FIG. 26 is a plan view of the power take-off in FIG. 25.

FIG. 27 is a midship section of an open plastic lifeboat, showing air tubes leading from the underside of the bottom, near the keel, to the inside below the gunwale top, for equalizing the air pressure inside and outside in a capsized lifeboat.

FIG. 28 is a larger scale section, similar to FIG. 27, showing the inner hull recess with an automatic drain fitting in the bottom, which is required in an open lifeboat, but not to be used in a lifeboat with a watertight cover. The equalizing air pressure tubes may not be installed in a lifeboat with a watertight cover.

FIG. 29 is an end view of a steel post on a platform with swivel wheels. It shows a horizontal pipe, securely attached to the lifeboat cavity mold, and rotating in said post in a position coinciding with the gravity center of the outer hull half of the plastic lifeboat. The completed inner hull half is installed and foam is poured while the outer hull half is still in the original fabrication mold.

FIG. 30 is a plan view of two plastic lifeboat halves, made in outer hull fabrication molds, as in FIG. 29, and replaced in molds which have been especially prepared, so that they can remain in place until all work has been accomplished; thus assuring that bonding adhesives have had time for undisturbed curing.

FIG. 31 is a side elevation of the joined lifeboat halves, together with the fairwater end, all clamped together with threaded rods and nuts through clips on the outside of especially prepared cut-away assembly molds.

FIG. 32 is a bow view of the joined lifeboat, including the fairwater end.

FIG. 33 is an upper end section of inner hull and outer hull, indicating a deflated rubber air tube under a rigid plastic cover; also, indicating the upper end of lifeboat skid fenders, which are abandoned after the boat is launched.

FIG. 34 is a section through the fully inflated side tube. The gunwale section indicates the method of attaching the rigid watertight cover to the gunwale box construction.

FIG. 35 is a full scale section of the dowel holding arrangement.

FIG. 36 is a side view of the dowel pull arrangement.

FIG. 37 is a dowel pull fitting.

Figure 38:
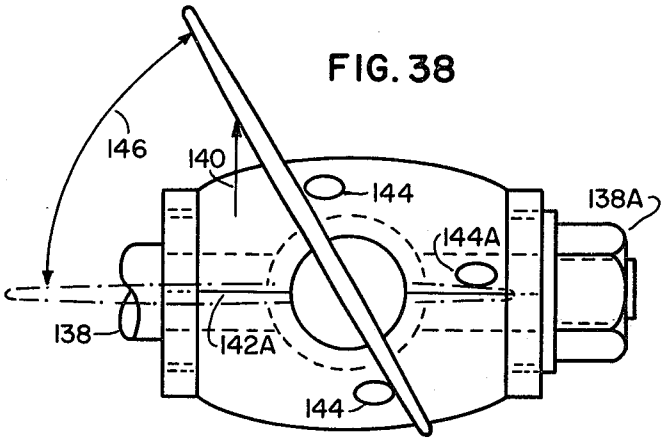

FIG. 38 shows the hub and blade arrangement of the bow-pull propeller. As soon as the shaft is rotated, each blade and it's disk stub will rotate, as a result of water pressure, until the blades are stopped by the bosses which are cast onto the outside of the three part hub shell.

Figure 39:
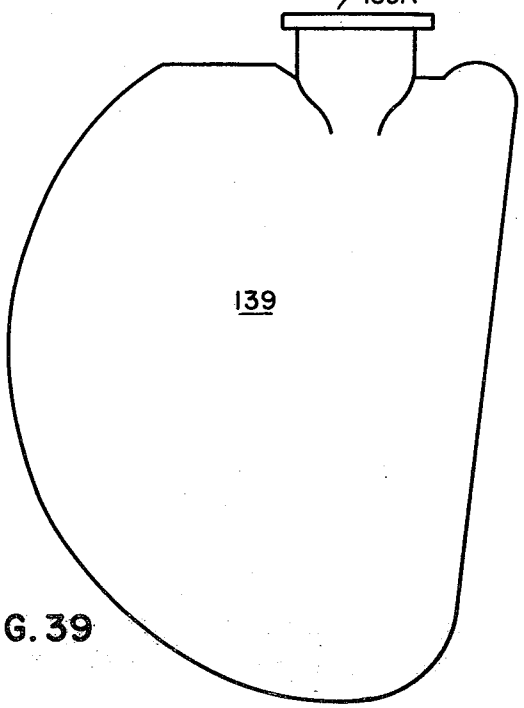

FIG. 39 is an outline drawing of one of the three propeller blades.

Figure 40:
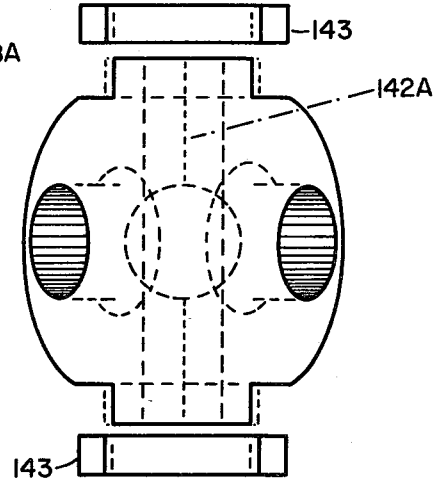

FIG. 40 is an outline view of the hub, and a separated view of the threaded rings; which, when screwed in place, hold the three hub shell pieces together.

Figure 41:
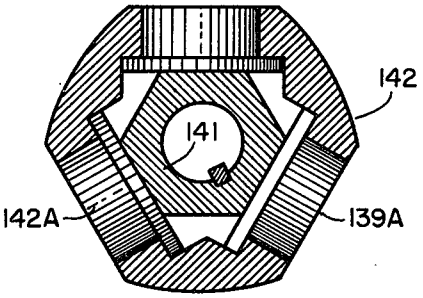

FIG. 41 is a section through the propeller hub, showing three hub shell pieces holding the blade-stub-disk faces against the hexagon sides of the hub center piece. The latter is bored to suit the shouldered end of the propeller shaft.

Figure 42:
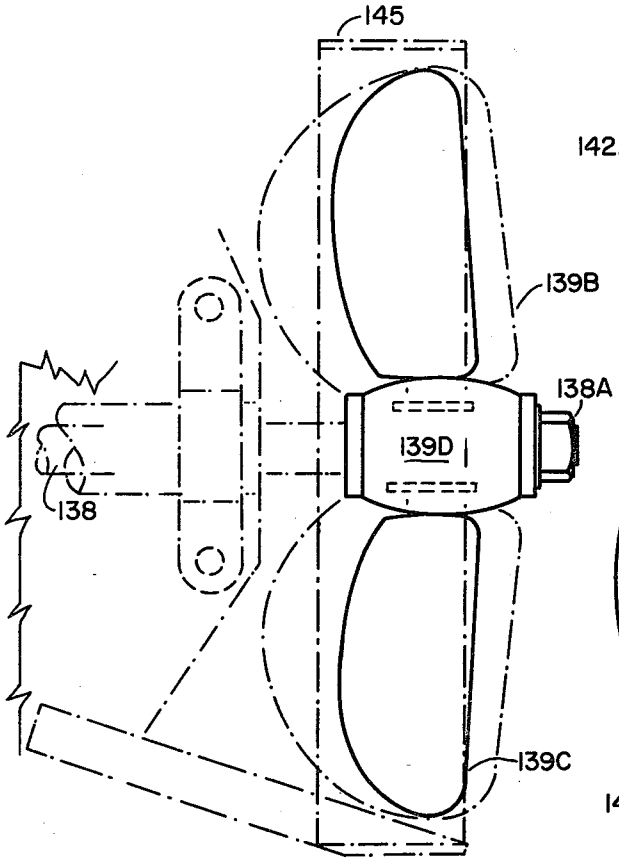

FIG. 42 shows the assembly of the pull-propeller installed at the bow of the lifeboat. A propeller guard has been indicated.

FIG. 43 is a section through the backbone pipe in way of the diesel engine installation.

FIG. 44 is a section through the upper end of the outer hull, which has an up-flange continued from the gunwale, and the bonding area of the rigid cover and of the inner hull is indicated. The gutter walkway on the gunwale top and the life line eyebolt in the nosing are shown. Because of severe strength tests, a vertical bolt is installed between inner and outer hull.

FIG. 45 is a section through the backbone pipe, which is resting on the keel, and it shows the vertical shaft with the energy flywheel and the brace connection to the longitudinal floor stringer, which also is connected to the girder below.

FIG. 46 is a section through the left and right side edges of the rigid cover top center piece and it's zigzag, up-flange connection to the watertight rigid cover side piece. For lifeboats with non-watertight covers, the canvas side pieces are directly connected to the zigzag up-flange of the cover top center piece, which is also a hand grab rail. Similar zigzag up-flanges are along the cover cross joints between hood and center piece.

Referring to illustrated structure by reference numbers, the hoisting hooks 13 may be released from davit shackles 11 under load by swinging lever 17, one half circle 12, and thereby rotating the rod 15, which is leading through universal ball joints 16 to the cup-shaped terminals 15A, which have a partly open side through which the engaged hook shanks of hook 13 are being released simultaneously at both ends. Occupants are shielded from harm by hook well 14 and the swing 12 of hook 13 can be observed through hinged window 102A. The cover-end hood 102 is made in a single mold with windows 97 and with upstanding zigzag lap-flange 110A. Because this lifeboat has a totally watertight cover side 101, the penetration of releasing rod 15 through the hook well wall is made watertight. The top center area of cover 98 is fitted all around it's four edges with zigzag upstanding flanges 110 and 110A, which are made to suit the adjacent cover sides 101 or cover end hoods 102. The zigzag flanges as stiffeners coincide with stanchions 23 and 46 below the cover, and they are ideal to be used as a grab rail for occupants walking on the gunwale walk-way 115.

The said top center cover area 98 is fitted with a pilot observation dome 117 having transparent material all around and on the top. It also has a hand operated wiper 121 for each half circle. Sprinkler water control cocks 51 on each side near pilot's chair 22 are for immediately getting emergency sprinkler water from tank 58, which is automatically replenished after the boat is launched. Arrangement for davit boat gripe cable 21 includes the preassembly installation of two large nuts for bolts 20 welded to a plate, which is secured inside the inner hull 112 for later bolting of gripe fitting 19 for the cable to run straight across from gunwale to gunwale in a weathertight-cover boat; or, to run through fairwater deck fitting 21A in a watertight-cover boat.

In gunwale-top walkway 115 there is a knuckle at the edge of the inner hull 112 and the nosing 116 with the normal camber of the gunwale deck creates a gutter-like depression for both boat types, watertight and weathertight. With the watertight cover, the gunwale will have an up-flange 113A and the rigid cover 101 will be extending from slightly below the gunwale deck up to the zigzag flange joint 110A with matching zigzag joint 110 of center area 98 and similar on opposite side. Both end connections of said rigid cover areas 101 to rigid cover-hoods 102 are by zigzag flange 110 and 110A. Each of the two rigid cover sides 101 have installed two rigid watertight hatches 118, each comprising two light metal hatch frames 118E and 118F with rounded corners, so dimensioned that one is overlapping the other all around, but the lap base is diagonal to the frame base and it has half round grooves for an endless round rubber gasket 119. A set of handles 118B (see FIG. A) are clamped together by bolt 118D through a slightly oversized in length bushing 118A. Hinge arrangement 118C for increased pressure on the gasket 119 and its effectiveness is shown by straight line 119A through upper and lower gasket positions and by hatch swing 118H; open position hatch-rest on block 120 secured by lanyard 120A. Reinforcement of hinge handles 118B is by web 118G, one for each handle. The lower two handles 118B in FIG. 6 have been indicated in an alternate position in case they should interfere with stiffener 104. For the weathertight-cover lifeboat, the side area between top piece 98 and gunwale gutter walkway 115 can be covered on each side in a rapid action fashion by the unrolling of three regular canvas flaps 99 and two exit and entrance flaps 100, which are permanently fixed to the zigzag up-flange 110 of rigid top 98. Each flap has in its lower end a pocket for small diameter tubes 93 and 94, which are made buoyant by closing the ends. Engine exhaust 84 to lead down below the floor and then up to just below the gunwale and then overboard, just above the side seat, all towards midship from the hoisting bulkhead.

Light weight, curved stanchion tubes 95 support weathertight covers 98, 99 and 100. Gunwale combination sockets 56 or 105 for rowlocks and stanchion tubes; clamping together of inner hull 112 and outer hull 113, which are also secured by bolt 122; sea water intake 106 for diesel engine, automatic drain with rubber ball and valve 107, bailing pipe to upper seat 108, air pressure equalizer 109 for capsized weathertight-cover lifeboat and coupling for tube 109A.

Rudder and rudder stock 34 are permanently supported by gudgeons 38, and rotated by a tiller quadrant 35, whose pinion and pinion shaft 36, is pointing to port side to avoid the hook well 14 and has a cable drum 41, with cable 39 running over fairlead sheaves 40 to drum 41A, at the lower end of sleeve 43, at whose upper end the steering stick 44 is attached, and both are rotating on stanchion 42 which is supporting the cover deck 98. Slanted stanchions 23 and 46 are steadying the cover against the rolling motions of the top weights in a seaway; inner hull stringer 64, with attached girder 63 underneath, comprising top straight part 63A, and preformed lower tension pipe 63B, bolts 63C and spreader tubes 63D between.

Backbone pipe 53, laid close to the straight part of the keel having suitable welded clips 83 and spreaders 82, which are bolted to the inner hull stringers 64 and are in close contact with reinforced foam filled inner hull sides and other items, including engine 30, energy flywheel 24, fuel tank 57, sprinkler water tank 58, drinking water 59, air-gas in pressure vessels 88 and 88A. Deflated rubber air tube 126, under a plastic cover 124, hanging under gunwale nosing 116, on longitudinal tubes 133, supported by stanchions 127; deflated tube secured in stowed position by remote control straps 128 and 129, which are held together by dowel 130 and may be released by pulling 130A on clip 130B; washer 132 and nut 131 are permanently affixed to two straps 128 and the two straps 129, which are then pulled tight through hole 124A for adding washer plate 132A and insert bolt 131A.

A drain hole 124B for water inside the cover; a cutout 124C in way of stanchions 127 along the upper edge of cover 124 is to permit closing of a possible gap between hull and tube cover. The release from stowage and the input of air will be done only in case of adverse weather. The skid fenders 125 will be jettisoned after the boat is waterborne. After dowels are pulled, incoming air through tube 134 will push the plastic cover 124 out of the way. The strap-belt 137 is of material similar in elastic quality to the air tube skin and is of ample width to prevent fouling; tube 134A has only a short stretch up stanchion 46 to reach the pilot's position 22.

Occupants 25 pull reciprocating cables 66 from pulleys 70 through hollow stanchions 23 in the middle of which the double cables 66 are joined to a single cable 66A, which is then joined together with 66B, to an endless cable ring 71 at the connection 71A. The teeth saber blades 75 are intraconnected within the ring, which runs over sheaves 72 having offset fulcrum pins 78, with the flywheel rotation 69. The teeth are engaging the pins 74A in the pinion rings 74, which are off the base plate 76, and the rubber or spring stoppers 77 will keep the saber blades 75 in position with the two endless rings 71 opposite from one another. The flywheel rings 81, base plate 76, hub 76A, spur rack ring 79, are a single assembly mounted on vertical shaft 26. Power take offs are for light 90, air pump 91, engine starting 80 and battery 91A. Also power take off worm gearing for propeller shaft 28 from vertical shaft 26 and worm gearing 68 for water pump 29. There is also a hand brake 33 and on the seat top a portable safety hand crank 27.

The joining of a one piece inner hull half 112 with a one piece outer hull half 113, in FIG. 21, demonstrates the advantage of making a lifeboat in two units, extending between hoisting bulkheads. After the inner hulls for each of the outer hull halves have been installed and foamed, each of the two hull side units are inside the assembly clamp machine and are placed side by side for clamping and bonding one to the other. The fairwater ends ae then put in their places for clamping and bonding. The clamping will assure quality and uniformity that cannot be achieved without it.

Reference numbers for the clamping machine are as follows: outer hull asssembly clamp 153A, fairwater assembly clamp 153B, outer hull finished boat 153C or 113, fairwater finished boat 153D or 112, universal ball joint 152G, post on carriage 151A, swivel casters 151B, lower platform 151C, upper platform 151E, pipe braces 151D, upper diagonal frame 152A, lower diagonal frame 152B, web plate 152C, rim pipes 152D, horizontal pipe 152E and threaded rod 152F. A bow-pull propeller assembly 139D, comprising horizontal shaft 138, three blades 139, each being held by a disk stock 139A under a three piece shell 142, each said disk stock is resting and turning on one side of the hexagon hub center piece 141, where the shell pieces are being held together on each side of the hub by threaded rings 143, and the unit attached to shaft by nut and washer 138A. At start of rotation, blades will move by force 140 along segment 146, until stopped by bosses 144 and continued rotation will move the boat ahead. Stopping the rotation will automatically return the blades against boss 144A. Loose fit of disks inside of hub can be achieved by changing shell piece widths at 142A. Propeller blade outline 139B shows neutral position and blade side view 139C shows action position. Protective propeller guard 145, which is made of expanded or perforated metal so as to avoid damage to same in heavy seas.

In one embodiment the plastic lifeboat 114 has a totally rigid and watertight cover, without thwarts or other athwartship bracing above the floor level, except a single thwart towards amidship adjacent to each end hoisting bulkhead at seat level, with a longitudinally level seat along each gunwale and with a level, double width, longitudinal center seat, which is slightly raised above the side seats. The thus created aisle on each side allows free walking without hindrance for the entire inside length (see FIG. 3). The watertight cover is made in five sections; (a) one symmetrical and slightly cambered center section 98; (b) two symmetrical side sections 101; (c) two symmetrical end hoods 102, each with a hook well 14. The zigzag formed flanges 110, 110A between the sections, remain perforce flush one to the other on the underside, and are cover stiffeners and also they offer a firm handhold for gunwale and deck walkers. A triple flanged joint is formed between gunwale top, inner hull flange and the symmetrical side section for the watertight connection of the rigid cover to the basic lifeboat hull (FIG. 21). Part of the triple flanged joint is the gunwale top connection 105 between outer hull 113 and inner hull 112 at top forming a gutter-like depression for its entire length, with an overboard drain at midship. The hook release swing area has a watertight hinged observation window 102A in the hook safety well 14. A small service hatch 97 is located in each end hood 102, on starboard aft and on port side forward, so that the end hoods remain alike and symmetrical. One elongated, transparent observation dome 117 is placed at midship center on the cover top 96 and is fitted with two hand wipers 121, which are operated from inside. On each side of center line top there is a sprinkler water pipe 58 (FIG. 8), with cocks 51 at the pilot seat. Right 23 and left 46 slanted cover stanchions are provided under the longitudinal zigzag stiffener on each side. The pre-installation of davit cable gripe fitting anchor bolt nuts 20 on the underside of the inner hull flange 119 is provided for later insertion of a fitting 19. A vertical and level rudder installation 34 is used to suit quadrant gear tiller pinion shaft 36 pointing to port side, away from the hoist hook 13 and passing through a watertight bushing 37 in the cover-end hood 102 with a cable drum 41 at its end leading fairlead sheaves 40 to a second cable drum 41*a* at the lower end of a vertical steering column 43 which is a sleeve on a stanchion 42 under the roof and it has the pilot's steering stick 44 at its upper end. The lifeboat has a support girder 63 under the inner hull strength floor stringer 64, which is substantially connected by a bolted structure 82 and by steel clips 83, welded to the backbone bilge pipe 53, which is resting on the plastic keel 55. Universal ball joints 16, intraconnected within a tubular rod 15 are used for the simultaneous release of hoist hooks 13 at each end of the lifeboat; each joint comprising a metal sphere or ball, with two cross center holes to suit three pins 18, 18A, the ball diameter to suit the inside diameter of the tubular rod without tolerance; the rod ends resemble ears with pin holes in their center. A bow-pull propeller 139D is provided having a horizontal shaft 138, three blades 139 with disk stumps 139A held loosely in a hub 142 and the disk of each blade is resting on one of the hexagon sides of the center piece 141, which is bored to suit the shaft 138, and two threaded rings 143 are holding the three piece threaded shell 142 together. A deflated rubber side tube 126 under a protective rigid cover 124 on each side of the lifeboat is ready to be activated at a moments notice when the pilot opens a valve 134A and pulls the dowel release cable 130B. The protective cover 124 is pushed away by the air filling the rubber tube 136. A heavy steel flywheel 24 is included, comprising two steel rings 81, one on the other, with a base plate 76 between the rings, a vertical shaft 26 extending from the keel pipe 53 to the center seat aove, with a hub 76A and two levels of drive pins 74A, which are being engaged by the teeth of two saber blades 75 on each level, which are reciprocating back and forth, activated by sixteen pull lines 66 from seated occupants 25. The saber blades are intraconnected within two endless cable rings 71. The top ring on the base plate 76 has on its periphery an endless tooth rack 79 for pinion power take-offs; the engaging and disengaging of such power take-offs are controlled by the pilot and may include the following pinion drives: diesel engine starting 80, centrifugal water pump 92, light bulbs, air pump 91, radio receiving, and radio transmitting. Power take-off drives through worm gears 67, 68 for the pull propeller 30 and the pressure water pump 29 are provided from the vertical shaft 26 of the flywheel. Furthermore, on the end of the shaft 26, a hand safety crank 27 for quick emergency use and a hand brake 33 to stop the wheel are provided. Tubes 48 are installed for passing air or wires through spaces to be foam filled later. Seat security is provided for each occupant which includes a regular lap seat belt 89, two sandal foot straps 86 on the floor and two hand hold straps 87 on the seat stringer.

In a second embodiment the plastic lifeboat has a partly rigid and partly weathertight, rapid action cover. The five section weathertight cover is basically identical to the watertight cover of the first embodiment. That is, the end hood service hatches 97 and the connections 105 to the gunwale and the deck of the basic lifeboat are weathertight and so are the top areas and the observation dome 117. The sprinkler pipes 58 are identical. The two side areas of the weathertight cover have three rolled-up canvas flaps 99, which are rolled down in rapid action and secured by straps. Two canvas flaps 100 for entrance and exit can also be handled and secured easily. The curved side stanchions 95 are for the weathertight cover only. Other cover support stanchions 23, 46, 47 are identical in either boat type. Other items for weathertight cover lifeboats are as follows: An equalizing air tube 109 passing through a foam filled inner hull tank which after a capsize, will automatically equalize the air pressure between outside air and air caught under the gunwale. A vertical tube 108 through the bottom of the lifeboat near the keel 55 and terminating at the top 61 of the longitudinal center line seat facilitates automatic bailing to the level of the seat for bailing with pail and funnel. An automatic drain fitting 107 is located near the keel of the lifeboat.

In both the watertight and weathertight lifeboats the propeller hub center 141 is a short piece of hexagon bar, bored to suit a shouldered shaft 138 which is threaded to suit washer and nut 138A. Each of the three blades 139 has a stock-stump with a disk-like end 139A, which rests on one of the hexagon center faces and the disk-like ends 139A are retained in their positions by three cover shells 142, oval on the outside, which are threaded when in their assembled positions. They are held together by a threaded ring 143 on each end of the assembled hub. Each of the oval shells 142 has bosses 144 for limiting the swing of the blades. At the beginning of rotation, the blades swing 146 automatically, because of water pressure, from center rest position 139B to the pull action position 139C; and, when rotation has stopped, the blades return to center rest position 139B.

Both embodiments provide means for occupants to participate in creating pull-cable energy by having the reciprocating teeth-saber blades 75 rotate, at high speed, a heavy wheel 65 in the bilge 60, and to have power take-offs, one or two at a time, as follows: worm drives 68, 67 for the pressure water pump 29 and for the bow propeller 390; pinion drives for diesel engine starting 80, centrifugal water pump 92, light bulbs 90, air pump 91, and radio receiving and radio transmitting. At high speed, the wheel will steady the lifeboat against rolling. All controls are actuated from the pilot's station 22. Each participating occupant pulls one cable stick 66 from an overhead pulley in a stanchion tube 23 through a short "pull cycle", followed by a "let go cycle". To facilitate the meshing and unmeshing of the saber blade teeth with the vertical pins 74A in the rings 74 around the wheel center, the connection of the endless cable rings 74 to the saber blades 75 is such that during the "pull cycle", the leading teeth are pulled slightly against the pins 74A for easy engagement, and during the "let go cycle" the leading teeth are pulled slightly away from the pins. There is a rubber spring loaded stopper 77 at the end of the "let go" cycle. The lower reciprocating teeth saber blades, which are not shown for reasons of clarity, are a full cycle ahead, so that there is pulling action on the wheel at all times. The brake 33 is for the convenience of the pilot, who is in charge of all power switching, including the use of the hand crank 27 for initial starting of the diesel engine 30. As an alternate to the pull lines, a ten-speed bicycle could be used as a power source.

A universal ball joint 16 is used in both embodiments of the lifeboats for convenient fairlead of a tubular rod 15 at about the floor level, coming up at each end to meet with the hook shank and having a cup 15A, which is partly open on one side, affixed to the ends of the rod 15. A release lever 17 in the rod 5, near pilot's position 22 can be swung 12 180 degrees for a simultaneous release of both hooks 13. The ends of the tubular rod 15 are machined to the required length and shaped to the form of two ears, with a hole in each to suit the pins 18, 18A, which are secured against sliding out by shouldered ends, set screws, or by thin spot-welded covers 18C. In the event that shouldered ends for the pins are being considered, they will be on one end only, and these three pins have a full diameter on their other ends, with the long pin 18A, being secured at the full diameter end by set screws or by a metal cover 18B. The only materials required for a complete universal ball joint are the three pins and the ball, which has a diameter to suit the inside diameter of the tubular rod.

A quadrant gear tiller 35 on a nearly vertical rudder stock 34 at the center line of both the weather and watertight lifeboats, aft of the transom, is provided with a nearly horizontal pinion shaft 36 rotating in stationary bearings 37 which are located diagonally towards port side so as not to interfere with the hoisting hook well 14. The pinion shaft passes through a watertight bushing 37 in the cover-end hood with a cable drum 41 at its end, and whose cable 39 leads over fairlead sheaves 40 to a second cable drum 41A at the lower end of a vertical steering column 45, which is a sleeve 43 on a vertical cover stanchion 42, and it has the pilot's steering stick 44 at its upper end.

The adjacent border flanges between each of the five lifeboat cover sections of both lifeboat embodiments are made to form a male 110 and female 110A zigzag; which, when clamped together, align themselves per force, each flush with its neighbor, without the necessity of a backing structure. The arrangement of having the zigzag flanges on the outside of the lifeboat cover is also for the protection of inside occupants and it provides hand grab rails for outside occupants. The surrounding of the hoist hooks 13 with partitions to form the hook safety well 14 has also kept the hook plates still connected to the hoisting bulkheads 13A and it provides protection for occupants against the swinging of the hook 13. The hinged window 102A is used for access to the hook well for reengaging the davit block shackle 11 after a test, and for observation during an emergency.

Both embodiments of the lifeboat further include a deck camber (see FIG. 21) of the fairwater ends 112 to be continued on the gunwale 115 between the hoisting bulkheads 13A and forming a walk way along the lifeboat cover. The top of the gunwale nosing 116 at its outboard side is kept about level with the inboard height of the gunwale 115. The thus created walk way gutter is adding to the safety of occupants. A drain has been left open on the gunwale top at midship for water from both ends. For boat and davit gripe security, the pre-installation of heavy nuts, welded to a long plate, which is secured inside of the gunwale box for later installation of the gripe fitting by heavy bolts 20, screwed to the heavy nuts, which are then used for holding the grip fitting 21A securely to the gunwale top. A regular overboard life line is secured to an eye bolt 123 under the nosing and thereby the life line is not cluttering the gunwale top. The gunwale walk way is safer still because of the longitudinal zigzag up-flange hand rail running the full length of the cover. The somewhat greater tendency of permanently covered lifeboats to capsize, can be met by added emphasis on security in seating of occupants and by low situated bilge weights. Occupants should not be kept tied up and then be allowed to release themselves by a single push button action, where they could not easily return to a positive hold. However, they can be given a regular lap seat belt 89 with a touch release buckle; and, this is important, be given in addition, sandle-like foot straps 86 on the floor and keep the feet in them while holding by hand onto hand straps 87 adjacent the knees of seated occupants.

The lifeboats have an under floor bilge area for the length of the inner hull 112, whose sectional appearance is like an upside-down, V-shaped, barn roof, (see FIG. 16) having a keelson 53 for a ridge pole and steel spreaders 82 for rafters, which are bolted securely to the inner hull stringers 64 on each side of the boat and welded to the keelson in the center. The stringers 64 are taking the place of a pole plate in the barn roof construction and are held in either case by strong steel cross beams 111 and they have been provided with additional support by a girder structure 63, comprising a curved tube 63B with tube spreaders 63D and bolts. The girders are installed before assembly. All heavy bilge items like diesel oil engine 30, fuel oil tank 57, first action sprinkler water tank 58, drinking water in cans 59, energy flywheel 24 and emergency pressure bottles 88 are securely wedged in and rest within the under-floor bilge area 62 between the keelson, the inner hull tanks and the floor of the lifeboat between the floor stringers. The factor of adherence of cured foam to the inner lifeboat tank skins is quite substantial and has been considered carefully. The framework of keelson 53 and spreaders 82 is prepared and installed as a unit and the keelson pipe 53 is laid in wet plastic fiberglass strips, but the spreader angles 82 are bolted to the stringers 64 and welded to the keelson.

The following are lifeboat items involved with the assembly of both embodiments: (a) two outer hull halves 153C with half hoisting bulkheads 13A, keel flanges, nosing 116, gunwale 115 and gunwale up-flange; (b) one bow fairwater-end with deck up-flange; (c) one stern fairwater-end with deck up-flange and with a rudder transom; (d) two cover-hood ends 102 with hook safety well 14, deck up-flange and zigzag flange 110 at top, (e) two inner hull halves 112 with gunwale box and with gunwale flange, keel recess and keel flange. Above items, (a) through (e), are each made in a single piece. Items (a) to (d) have their lay-up starting coat facing the outside of the boat. Item (e), the inner hull has its starting coat facing the center line of the boat. For use with the assembly of basic lifeboat parts, a separate set of molds is duplicated from items (a), (b), and (c), which are being prepared with cut-away areas. The outer hull assembly mold 153C, item (a), is fitted with a "V" shaped steel web and pipe structure 151E, which is fitted with a pipe extension 152E on each end, adapted to be resting in a turnable position in an upright pipe post 151A, which is on a carriage platform 151C with swivel casters 151B underneath. A univsersal ball joint 152G is installed in the pipe extension, close to the upright pipe post 151A, for raising one boat end higher than the other. The two boat halves are thus rolled to side by side position and clamped together by threaded rods with nuts 152F.

Both embodiments of the lifeboat include a deflated rubber tube 126 under a protective rigid plastic or metal cover 124 on each side below the gunwale 115 and nosing 116 of the lifeboat. The protective rigid cover 124, bulging out from the outer hull, but still within the outside face of the nosing 116 allows space close to the boat side for the stowing of a deflated and folded rubber tube 126. The edges of the rigid rubber tube cover are fitted with reasonable tolerance to the boat side in a position suitable for support by the two longitudinal metal or plastic pipes 133, which are held by low stanchions 127, situated in two grooves below the nosing. The upper edge of the protective tube cover is hooked under the upper pipe, and the lower edge is pulled close to the underside of the lower pipe with straps 128, 129 which are releasable by the remote pulling of a keeper-dowel 130. After such release, the incoming air will push the lower edge of the protective cover 124 away from the boatside, and thereby jettison same. However, before this can be accomplished, and in any case after the lifeboat is waterborne, the two skid fenders 125 must also be abandoned. This is done by a remote wire pull. Inflating the rubber tubes 136 with air should only be considered during the approach of bad weather.

I claim:

1. A fiberglass-reinforced plastic (F-RP) lifeboat with a totally rigid and watertight cover, without thwarts or other athwartship bracing above the floor level, except a single thwart towards amidship adjacent to each end-hoisting bulkhead at seat level, with a longitudinally level seat along each gunwale and with a level, continuous double width, longitudinal center seat, being slightly raised above the side seats, thus creating an aisle on each side allowing free walking without hindrance for the entire inside length; and said watertight cover being made in five sections; (a) one symmetrical and slightly cambered center section; (b) two symmetrical side sections; (c) two symmetrical end hoods, each with a hook well; and zigzag formed flanges between the sections remaining perforce flush one to the other on the underside, acting as cover stiffeners and offering a firm handhold for gunwale and deck walkers; and a triple flanged joint between gunwale top, inner hull flange and said symmetrical side section for the watertight connection of the rigid cover to the basic lifeboat hull; and part of said triple flanged joint being the gunwale top connection between outer hull and inner hull at top, forming a gutter-like depression for its entire length, with an overboard drain at midship on each side; and a hook release swing area with a watertight hinged observation window in said hook well; a small service hatch in each end hood or starboard aft and on port side forward, the end hoods therefore remaining alike and symmetrical; one elongated, transport observation dome at midship center on cover top, fitted with two hand wipers being operated from the inside; on each side of center line top a sprinkler water pipe with cocks at the pilot seat; right and left slanted cover stanchions, under the longitudinal zigzag stiffener on each side; pre-installed davit cable gripefitting anchor bolt nuts on the underside of the inner hull flange for later insertion of fitting; a vertical and level rudder installation to suit quadrant gear tiller pinion shaft, pointing to port side, away from the hoist hook and passing through a watertight bushing in said cover-end hood with a cable drum at its end leading over fairlead sheaves to a cable drum at the lower end of a vertical steering column being a sleeve on stanchion under the roof which has the pilot's steering stick at its upper end; a support girder under the inner hull strength floor stringer, being substantially connected by bolted structure and by steel clips, welded to a back bone bilge pipe, and resting on the plastic keel; universal ball joints, intraconnected within a tubular rod for the simultaneous release of hoist hooks at each end of the lifeboat; each joint comprising a metal sphere or ball, with two cross center holes to suit three pins, the ball diameter to suit the inside diameter of the tubular rod without tolerance; the rod ends resembling ears with pin holes in their center; a bow pull propeller, having a horizontal shaft, three blades with disk stumps held loosely in a three piece hub shell; and the disk of each said blade resting on one of the hexagon sides of a center piece, said center piece having been bored to suit the shaft and two threaded rings holding the three-piece threaded shell together; a deflated rubber side tube stowed under a protective, portable rigid cover on each side of the boat, ready to be inflated at a moment's notice by pulling a dowel release cable and by opening a pressure air valve, both from the pilot station, resulting in the automatic abandonment of said protective covers by having same pushed out of the way when the air pressure is filling the tubes; a heavy steel flywheel, comprising two rings, one on top of the other, with a base plate between the rings, a vertical shaft extending from a keel pipe to the center seat above, with a hub and two levels of drive pins, said pins being engaged by the teeth of two saber blades on each level, said blades reciprocating back and forth, activated by sixteen pull lines from seated occupants; said saber blades being intraconnected within two endless cable rings; said top ring on the base plate having on its periphery an endless tooth rack for pinion power take-offs; engaging and disengaging of such power take-offs being controlled by the pilot and including the following pinion drives: diesel engine starting, centrifugal water pump, light bulbs, air pump, radio receiving, radio transmitting, power take-off drives through worm gears for the pull propeller and the pressure water pump from the vertical shaft of the flywheel; furthermore, on the end of said vertical shaft, a hand safety crank for quick emergency use and a hand brake to stop the wheel; tubes installed for passing air or wires through side air tank spaces to be foam-filled later; in addition to a regular lap seat belt, two sandal foot straps on the floor and two hand hold straps on a seat stringer.

2. A fiberflass-reinforced plastic (F-RP) lifeboat with a partly rigid and partly weathertight, rapid action cover, without thwarts or other athwartship bracing above the strength floor level, except a thwart adjacent to a hoisting bulkhead on each end at seat level, with a longitudinally level seat along each gunwale and with a level, double width, longitudinal center seat; said longitudinal seat slightly raised above the side seats; the thus created aisle on each side allowing free walking without hindrance for the entire inside length; said weathertight cover being made in five sections including (a) one symmetrical and slightly cambered center section, (b) two symmetrical side sections, and (c) two symmetrical end hoods, each with a hook well; zigzag formed flanges between the sections remaining flush one to the other on the underside, acting as cover stiffeners and offering a firm handhold for gunwale and deck walkers; a hook release swing area with a watertight hinged observation window in said hook well; a small service hatch in each end hood on starboard aft and on port side forward, the end hoods therefore remaining alike and symmetrical; one elongated transparent observation dome at midship center on cover top, fitted with two hand wipers being operated from the inside; on each side of centerline top a sprinkler waterpipe with cocks at the pilot seat; the two side sections, port and starboard, of the weathertight cover having on each side five rolled-up flaps, including two on each side for rapid entrance and exit, all can be handled safely for quick release; right and left slanted cover stanchions, under the longitudinal zigzag stiffener on each side; curved side stanchions for supporting the weathertight cover; pre-installed davit cable gripefitting anchor bolt nuts on the underside of the inner hull flange for later insertion of a gripe cable fitting; a vertical and level rudder installation to suit quadrant gear tiller pinion shaft, pointing to port side, away from the hoist hook and passing through a watertight bushing in said cover-end hood with a first cable drum at its end leading over fairlead sheaves to a second cable drum at the lower end of a vertical steering column being a sleeve on a stanchion under the roof which has the pilot's steering stick at its upper end; a support girder under the inner hull strength floor stringer, being substantially connected by a bolted structure and by steel clips, welded to a backbone bilge pipe, and resting on the plastic keel; universal ball joints, intraconnected within a tubular rod for the simultaneous release of hoist hooks at each end of the lifeboat, each joint comprising a metal sphere or ball, with two cross center holes to suit three pins, the ball diameter to suit the inside diameter of the tubular rod without tolerance, the rod ends resembling ears with pin holes in their center; a bow-pull propeller having a horizontal shaft, three blades with disk stumps held loosely in a three-piece hub shell, the disk of each said blade resting on one of the hexagon sides of a center piece, said center piece having been bored to suit the shaft and two threaded rings holding the three-piece shell together; a deflated rubber side tube stowed under a protective portable rigid cover on each side of the boat, ready to be inflated by pulling a dowel release cable and by opening a pressure air valve, both from the pilot station, resulting in the automatic abandonment of said protective covers by having the same pushed out of the way when the air pressure is filling the tubes; a heavy steel flywheel, comprising two rings, one on top of the other, with a base plate between said rings, a vertical shaft extending from a keel pipe to said center seat above, with a hub and two levels of drive pins, said pins being engaged by the teeth of two saber blades on each level, said blades reciprocating back and forth, activated by sixteen pull lines from seated occupants, said saber blades being intraconnected within two endless cable rings, said top ring on the base plate having on its periphery an endless tooth rack for pinion power take-offs; engaging and disengaging of such power take-offs being controlled by the pilot and including the following pinion drives: diesel engine starting, centrifugal water pump, light bulbs, air pump, radio receiving and radio transmitting; power take-off drives through worm gears for the pull propeller and the pressure water pump from the vertical shaft of the flywheel; furthermore, on the end of said vertical shaft, a hand safety crank for quick emergency use and a hand brake to stop the wheel, installation of tubes for passing air or wires through side air tank spaces to be foam filled later; in addition to a regular lap seat belt, two sandal foot straps on the floor and two hand hold straps on a seat stringer; other items for weathertight cover lifeboats as follows: an equalizing air tube passing through a foam filled inner hull tank which, after a capsize, will automatically equalize the air pressure between outside air and air caught under the gunwale; a vertical tube through the bottom of the lifeboat near the keel, terminating at the top of the longitudinal center line seat facilitating automatic bailing to the level of the seat and bailing with pail and funnel; and an automatic drain fitting located near the keel of the lifeboat.

3. A fiberglass-reinforced plastic lifeboat, as recited in claim 1 or claim 2, said bow-pull propeller of said lifeboat being such as to allow each said blade to automatically rotate, through water pressure, from a boat center position to a forward action position; said hub shell of the bow-pull propeller being oval shaped and threaded on each end when in its assembled position and held together by threaded rings, each piece of said three-piece hub shell having bosses for limiting the swing of the blades; when rotation of propeller has stopped, said blades will return from the forward action position to the center rest position; this latter action is also taking place automatically through water pressure.

4. A fiberglass-reinforced plastic lifeboat, as recited in claim 1 or claim 2, including means provided for occupants to rotate said heavy flywheel in the bilge; said means comprising one cable stick of each said pull line to be pulled by a participating occupant from an overhead pulley in a stanchion tube through a short "pull cycle", followed by a "let go cycle"; to facilitate the meshing and unmeshing of the saber blade teeth with said pins in rings around the wheel center, the connection of the endless cable rings to the saber blades is such that during the "pull cycle" the leading teeth are pulled slightly against the pins for easy engagement, and during the "let go cycle" the leading teeth are pulled slightly away from the pins; a rubber or spring loaded stopper at the end of the "let go" cycle giving a pulley signal to the boat occupants; the lower reciprocating teeth saber blades being a full cycle ahead, so that there is pulling action on the wheel at all times; and said hand crank further being used for initial starting of the diesel engine.

5. A fiberglass-reinforced plastic lifeboat, as recited in claim 1 or claim 2, further including means for the simultaneous release of hoist hooks at each end of the lifeboat, said releasing means comprising a universal ball joint for convenient fairlead of a tubular rod at about the floor level, coming up at each boat end to meet with a hook shank and having a cup, which is partly open on one side, affixed to the ends of the rod; a release lever in the rod, near the pilot's position to be swung 180 degrees for a simultaneous release of both hooks; the ends of the tubular rod being machined to the required length and shaped to the form of two ears, with a hole in each to suit three pins, which are secured against sliding out.

6. A fiberglass-reinforced plastic lifeboat, as recited in claim 1 or claim 2, further including said quadrant gear tiller and a nearly vertical rudder stock at the center line of the boat, aft of the transom, with a nearly horizontal pinion shaft rotating in stationary bearings located diagonally towards port side so as not to interfere with the hoisting hook well.

7. A fiberglass-reinforced plastic lifeboat, as recited in claim 1 or claim 2, further including adjacent border flanges between each of the five lifeboat cover sections being made to form a male and female zigzag flange, said zigzag flanges when clamped togther, align themselves per force, each flush with its neighbor, without the necessity of a backing structure; the arrangement of having said zigzag flanges on the outside of the lifeboat cover being also for the protection of inside occupants and providing hand grab rails for outside occupants; the hoisting hooks being surrounded with partitions to form the hook safety well, said partitions being interconnected and attached to the hoisting bulkhead and being part of the cover, allowing occupants to be crowded very close to hoisting hooks without any danger whatsoever from the swinging hoisting hook; a hinged window in the hook well for access to said hook to reengage the davit block shackle after a test and to be able to observe during an emergency.

8. A fiberglass-reinforced plastic lifeboat, as recited in claim 1 or claim 2, further including a deck camber of the fairwater ends continuing on the gunwale between the hoisting bulkheads, said chamber being of advantage for forming a walk way along the lifeboat cover by turning the nosing top at its outboard edge to approximately the same height as the inside edge of the gunwale top and thereby forming a safe walkway or gutter; a drain left open on the gunwale top in the nosing at midship for water from both ends; for boat and davit gripe security, the pre-installation of heavy nuts, having been welded to a long plate and secured temporarily underneath the gunwale flange of the inner hull, for later installation of the gripe fitting and secured by heavy tap bolts; a regular overboard life line being secured in bights from eye bolts below the nosing and thereby not cluttering the gunwale top; the gunwale walk way being made safer still because of the longitudinal zigzag up-flange hand rail running the length of the cover; the somewhat greater tendency of permanently covered lifeboats to capsize being met by added emphasis on seating of occupants by providing in addition to a regular lap seat belt with a touch release buckle, sandal-like foot straps on the floor and hand straps adjacent to the knees of a seated occupant on the seat of stringers.

9. A fiberglass-reinforced plastic lifeboat, as recited in either claim 1 or claim 2, wherein an under floor bilge area extends for the length of the inner hull whose sectional appearance is like an upside-down generally V-shaped barn roof, having a keelson for a ridge pole and steel spreaders for rafters, said spreader being bolted securely to an inner hull stringer on each side of the boat and welded to the keelson in the center; said stringers taking the place of pole plates in said barn roof construction and being held in either case by strong steel cross beams and by a girder structure, installed to inner hull before assembly, comprising a curved tube with tube spreaders; the framework of keelson and spreaders being prepared and installed as a unit and the keelson pipe being laid in wet plastic fiber glass strips; being bolted to the stringers and to steel clips which are welded to the keelson pipe.

10. A fiberglass-reinforced plastic lifeboat, as recited in claim 1 or claim 2, further including said protective rigid cover bulging out from the outer hull but still within the outside face of the nosing allowing space close to the boat side for the stowing of a deflated and folded rubber tube; the edges of the rubber tube cover being fitted to the boat side in a position suitable for support by two longitudinal pipes, being supported by low fittings in two longitudinal grooves in the outer hull below the nosing; the upper edge of said protective tube cover being hooked under the upper pipe, and the lower edge pulled close to the underside of the lower pipe with straps, being releasable by the remote pulling of a keeper-dowel; that after such release, causing inflation of the tube, the incoming air will push the lower edge of the protective cover away from the boatside, and thereby jettison same.

* * * * *